US012031345B2

(12) United States Patent
Cochrane et al.

(10) Patent No.: US 12,031,345 B2
(45) Date of Patent: Jul. 9, 2024

(54) MAST WITH A MECHANISM FOR PIVOTING THE ELONGATE POST

(71) Applicant: COCHRANE GULF FZE, Dubai (AE)

(72) Inventors: Alexander Richard Cochrane, Kempton Park (ZA); Vlado Bucarizza, Dubai (AE)

(73) Assignee: COCHRANE GULF FZE, Dubai (AE)

( * ) Notice: Subject to any disclaimer, the term of this patent is extended or adjusted under 35 U.S.C. 154(b) by 58 days.

(21) Appl. No.: 17/910,171

(22) PCT Filed: Mar. 9, 2021

(86) PCT No.: PCT/IB2021/051943
§ 371 (c)(1),
(2) Date: Sep. 8, 2022

(87) PCT Pub. No.: WO2021/181263
PCT Pub. Date: Sep. 16, 2021

(65) Prior Publication Data

US 2023/0145704 A1 May 11, 2023

(30) Foreign Application Priority Data

Mar. 9, 2020 (ZA) ..... 2020/01462

(51) Int. Cl.
*E04H 12/34* (2006.01)
*E04H 12/18* (2006.01)
(Continued)

(52) U.S. Cl.
CPC ..... *E04H 12/345* (2013.01); *E04H 12/187* (2013.01); *E04H 12/20* (2013.01); *E04H 12/2261* (2013.01)

(58) Field of Classification Search
CPC ..... E04H 12/345; E04H 12/187; E04H 12/20; E04H 12/2261; E04H 12/34
(Continued)

(56) References Cited

U.S. PATENT DOCUMENTS 2,213,870 A * 9/1940 Scholl ..... E04H 12/187 52/125.2
2,822,066 A * 2/1958 Hanson ..... E04H 12/187 416/142
(Continued)

FOREIGN PATENT DOCUMENTS

AU 2016228198 A1 10/2016
AU 2019100584 A4 7/2019
(Continued)

OTHER PUBLICATIONS

International Search Report and Written Opinion for Application No. PCT/IB2021/051943 dated Apr. 26, 2021 (10 pages).
(Continued)

*Primary Examiner* — Brent W Herring
(74) *Attorney, Agent, or Firm* — MICHAEL BEST & FRIEDRICH LLP

(57) ABSTRACT

A mast (10) which includes an elongate post (12) with a first end (14) and a second end (16), the first end (14) being pivotally secured to a ground-engaging support base, at least a first mechanism (22) to restrict pivotal movement of the post (12), a winch (26) which is attached to the post (12), and a cable (28) which is engaged with the winch (26) and which is secured at one end to an anchor (30), wherein the winch (26) is actuable to allow the post (12) to pivot, from an elevated position, in a first direction (54) which lowers the post (12) against the action of the movement restricting first
(Continued)

mechanism (22), and which is actuable to pivot the post (12) in a second direction (56) which opposes the first direction (54) to elevate the post (12).

7 Claims, 3 Drawing Sheets

(51) Int. Cl.
*E04H 12/20* (2006.01)
*E04H 12/22* (2006.01)

(58) Field of Classification Search
USPC ..... 52/122.1, 116, 120
See application file for complete search history.

(56) References Cited

U.S. PATENT DOCUMENTS 2,985,261 A * 5/1961 Kubesh ..... E04H 12/187 174/45 R
5,611,177 A * 3/1997 Herbstritt ..... B60P 3/18 212/293
6,308,802 B1 * 10/2001 Briere ..... B66B 9/16 187/242
7,089,705 B1 8/2006 Lieberman
9,883,147 B1 * 1/2018 Zaluski ..... H01Q 1/1228
10,781,603 B1 * 9/2020 Darragh ..... E04H 12/187
11,613,902 B1 * 3/2023 Reski ..... E04H 12/08 52/116
11,613,905 B1 * 3/2023 Lee ..... E04H 12/345 52/116
11,808,091 B1 * 11/2023 Van Ee ..... E04H 12/345
2015/0308140 A1 * 10/2015 Clifton ..... E02D 27/42 248/346.2
2016/0060890 A1 3/2016 Van Wyk
2021/0347616 A1 * 11/2021 Jathmi ..... B66D 5/04
2023/0060029 A1 * 2/2023 Shalouf ..... E04H 12/345

FOREIGN PATENT DOCUMENTS

CA 3001820 A1 10/2019
EP 3536878 A1 9/2019
GB 2425296 A * 10/2006 ..... E04H 17/263

OTHER PUBLICATIONS

International Preliminary Report on Patentability for Application No. PCT/IB2021/051943 dated Sep. 13, 2021 (5 pages).

* cited by examiner

MAST WITH A MECHANISM FOR PIVOTING THE ELONGATE POST

CROSS-REFERENCE TO RELATED APPLICATIONS

This application is a U.S. national phase application of International Application No. PCT/IB2021/051943 filed Mar. 9, 2021, which claims priority to South African Application No. ZA 2020/01462 filed Mar. 9, 2020, the entire contents of both of which are herein incorporated by reference.

BACKGROUND OF THE INVENTION

This invention relates to a mast.

Typically, a mast comprises an elongate post which is fixed to the ground. Components such as electrical equipment, e.g. security cameras, sensors, screens, or the like can be attached to an upper end of the post for monitoring and surveillance purposes.

Usually to safeguard such components against attack, vandalism and theft, the post is elongate with an upper end which is well above ground level.

The length of the post means a ladder is required for service of the components etc. This is time consuming and inherently there are dangers associated with ladders. If a post is pivoted to ground level for maintenance or access purposes, the weight of the post can give rise to problems.

Care must be exercised when the post is lowered to the ground for serious injuries or death, and damage to the components, can arise due to the weight of the post.

Generally, once the components have been accessed, the post must be elevated, and secured, in its vertical position, a process which can be laborious and dangerous.

The invention aims to address the aforementioned issues.

SUMMARY OF INVENTION

The invention provides a mast which includes an elongate post with a first end and a second end, the first end being pivotally secured to a ground-engaging support base, at least a first mechanism to restrict pivotal movement of the post, a winch which is attached to the post, and a cable which is engaged with the winch and which is secured at one end to an anchor, wherein the winch is actuable to allow the post to pivot, from an elevated position, in a first direction which lowers the post against the action of the movement restricting first mechanism, and which is actuable to pivot the post in a second direction which opposes the first direction to elevate the post.

The first mechanism may comprise any suitable arrangement and preferably includes a piston and cylinder arrangement which acts between the post and the support base to inhibit pivotal movement of the post, in the first direction, away from a vertical position.

The piston and cylinder arrangement acts in a shock-absorbing way to restrict abrupt movement of the post, to enhance safety of operating for the arrangement inhibits free pivotal movement of the post as the post is lowered in the first direction to a predetermined angular extent relative to the vertical but allows such movement to take place in a gradual and controlled way.

The mast may include a second mechanism to restrict/stop pivotal movement of the post in the first direction. The second mechanism may act as a support which automatically becomes effective when the post is at a predetermined orientation relative to the vertical. The second mechanism may comprise a free-hanging elongate body which is attached to the post.

The body is movable under gravity action and takes up an orientation which allows the body to be ground-engaging, so as to support the post, when the post is lowered to a predetermined angular position relative to the vertical. This is a useful feature if the second upper end of the post is to be accessed, e.g. for maintenance purposes. Additionally, though, the free-hanging body provides a back-up safety feature for, if the first mechanism should fail, the free-hanging body would prevent the post from hitting the ground.

The winch may be actuated manually or electrically.

The anchor may be at any suitable location and may comprise any suitable member or component. Preferably the anchor comprises an elongate member which is rigidly fixed to the support base and which defines an anchor point, for the cable, which is located at an elevated location above the ground.

The post may include a flange at the first end which is secured to the support base. The flange may be pivotally secured to the support base in any appropriate way using suitable fasteners which allow the post to be pivotable relative to the support base.

Sensing, monitoring, surveillance, communication and security components may be mounted at the second end of the post. The components, without limitation, may for example include a camera, a monitor, or the like.

The components may be protected by means of one or more deterrent elements which are secured at an elevated position to the post. The deterrent elements may be razor wire, barb wire, barb tape, spikes or the like.

BRIEF DESCRIPTION OF THE DRAWINGS

The invention is further described by way of example with reference to the accompanying drawings in which.

DESCRIPTION OF PREFERRED EMBODIMENT

Figure 1:
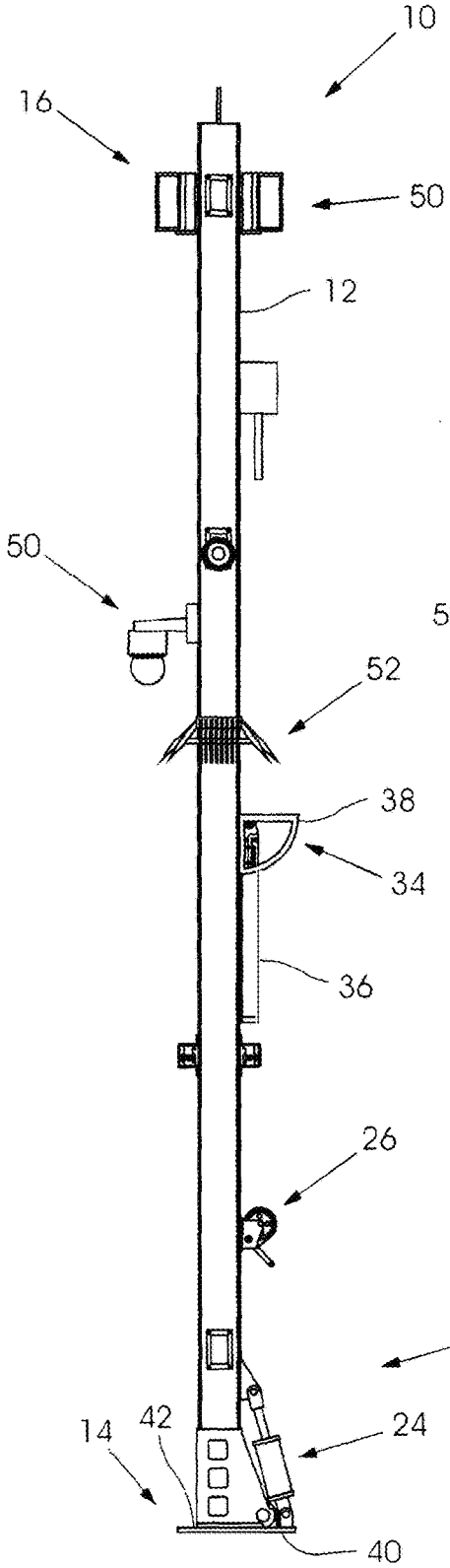
FIG. 1 is a side view of a mast according to the invention.

FIG. 1 of the accompanying drawings is a side view of a mast 10 according to the invention.

Figure 2:
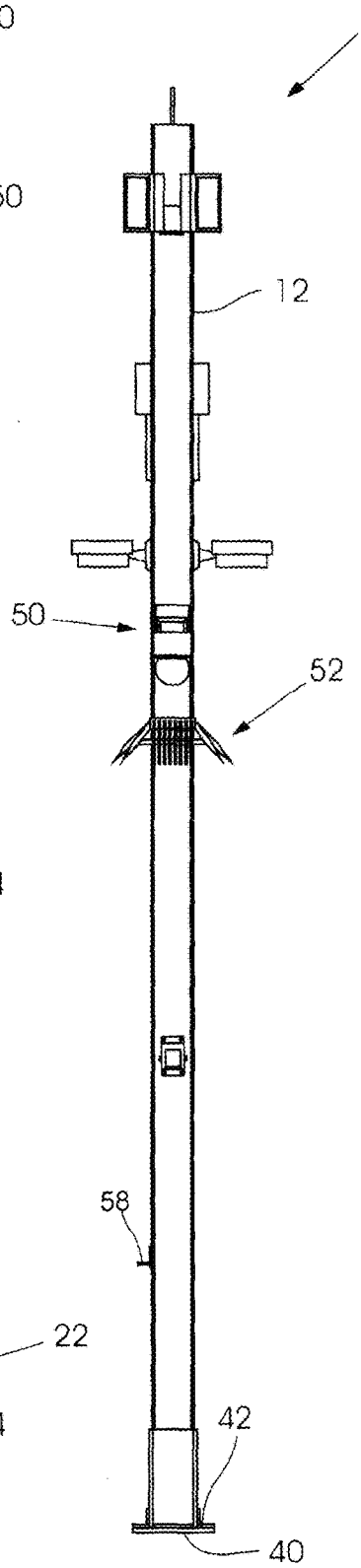
FIG. 2 is a view from another side of the mast shown in FIG. 1.
Figure 3:
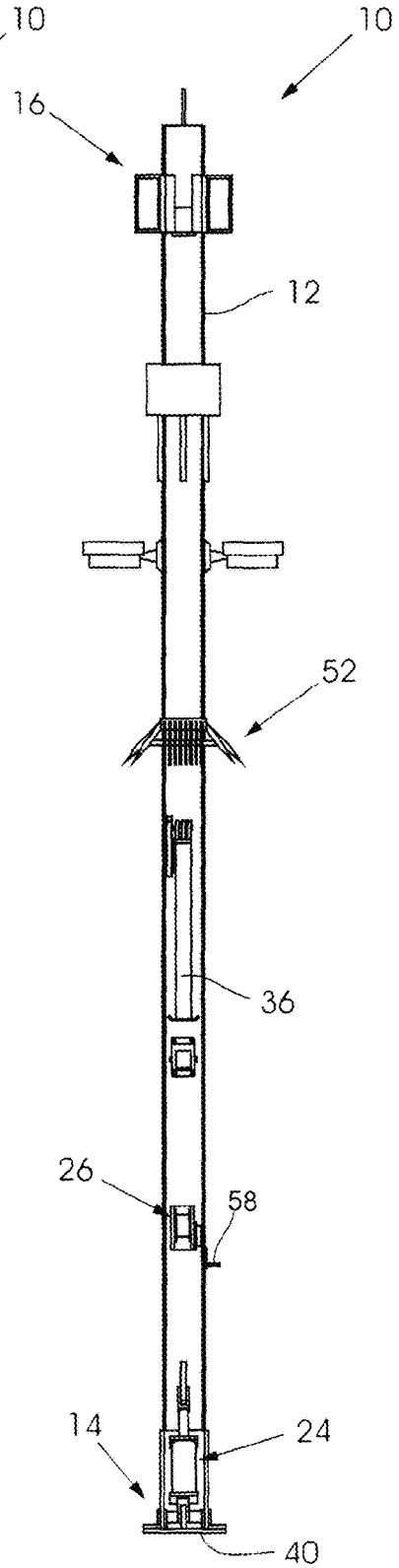
FIG. 3 is a view from an opposing side of the mast shown in FIG. 2.
Figure 4:
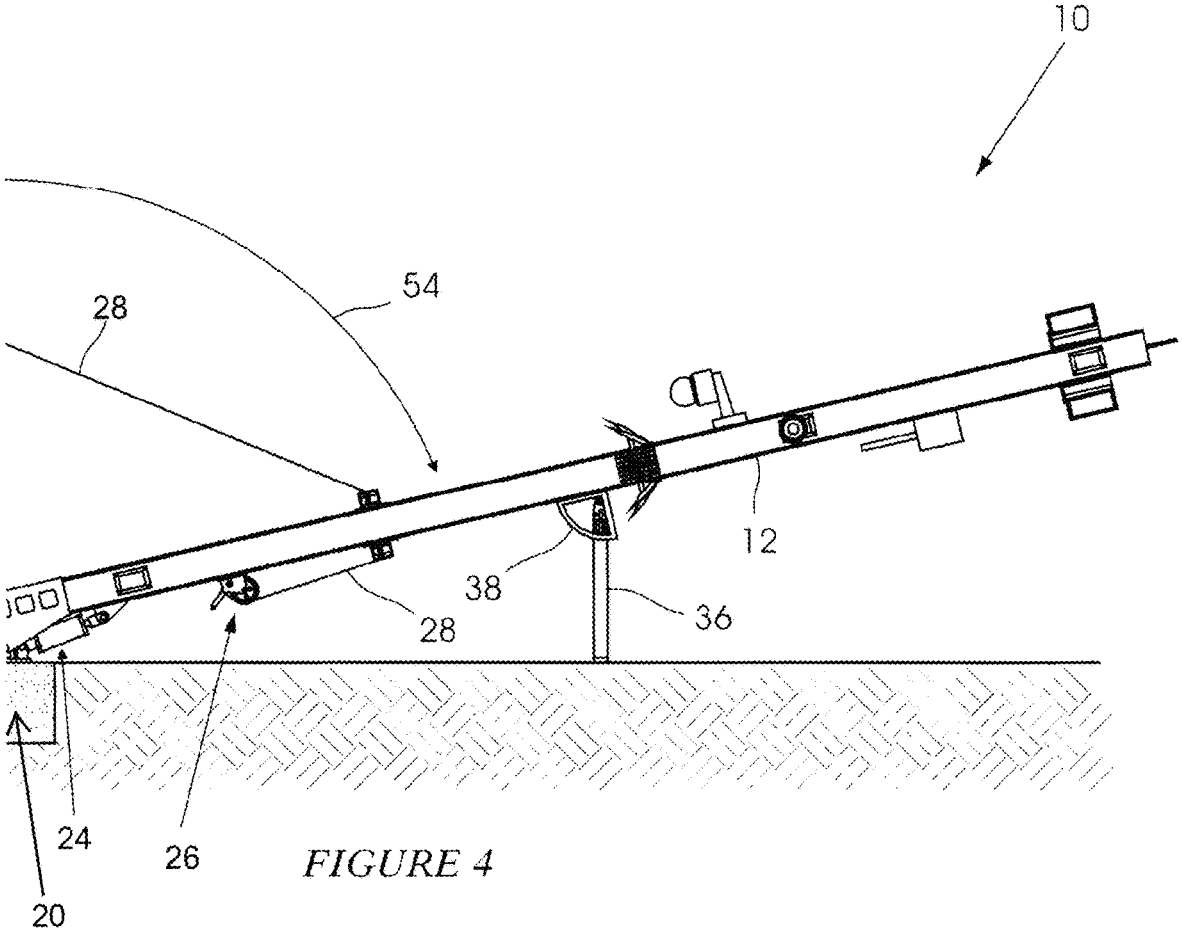
FIG. 4 is a side view of the mast shown in FIG. 1, in use, pivoted to a first position.

The mast 10 includes an elongate post 12 with a first end 14 and a second end 16. The first end 14 is pivotally secured to a ground-engaging support base 20 (shown in detail in FIG. 4). FIG. 2 shows a view from another side of the mast 10 and FIG. 3 shows a view from an opposing side of the mast 10.

A first mechanism 22 comprises a piston and cylinder arrangement 24 and is attached to and between the post 12 and the base 20.

A winch 26 is attached to the post 12 at an intermediate location. A cable 28 is engaged with the winch 26 and is secured at one end to an anchor point 30 which is at an elevated position on a rigid support member 32 which is fixed at a lower end of the support base 20 and which extends upwardly from the base in a vertical direction.

The mast 10 also includes a second mechanism 34. The second mechanism 34 comprises a free-hanging elongate body 36 which is pivotally attached to the post 12 more or less at a central location on the post 12.

The second mechanism 34 is attached to the post 12 via a bracket 38. This is exemplary only.

The post 12 includes a flange 40 at the first end 14 which is secured to the support base 20. The flange 40 is pivotally secured to the support base in any appropriate way using suitable fasteners 42, e.g. bolts, which allow the post to be pivotable relative to the support base 20.

Sensing, monitoring, surveillance, communication and security components 50 are mounted to the post 12 at its second end 16. The components, without limitation, are for example a camera, a monitor, or the like.

The components 50 are protected by means of one or more deterrent elements 52 which are secured to the post 12 at an elevated position. The deterrent elements 52 are razor wire, barb wire, barb tape, spikes or the like.

Figure 5:
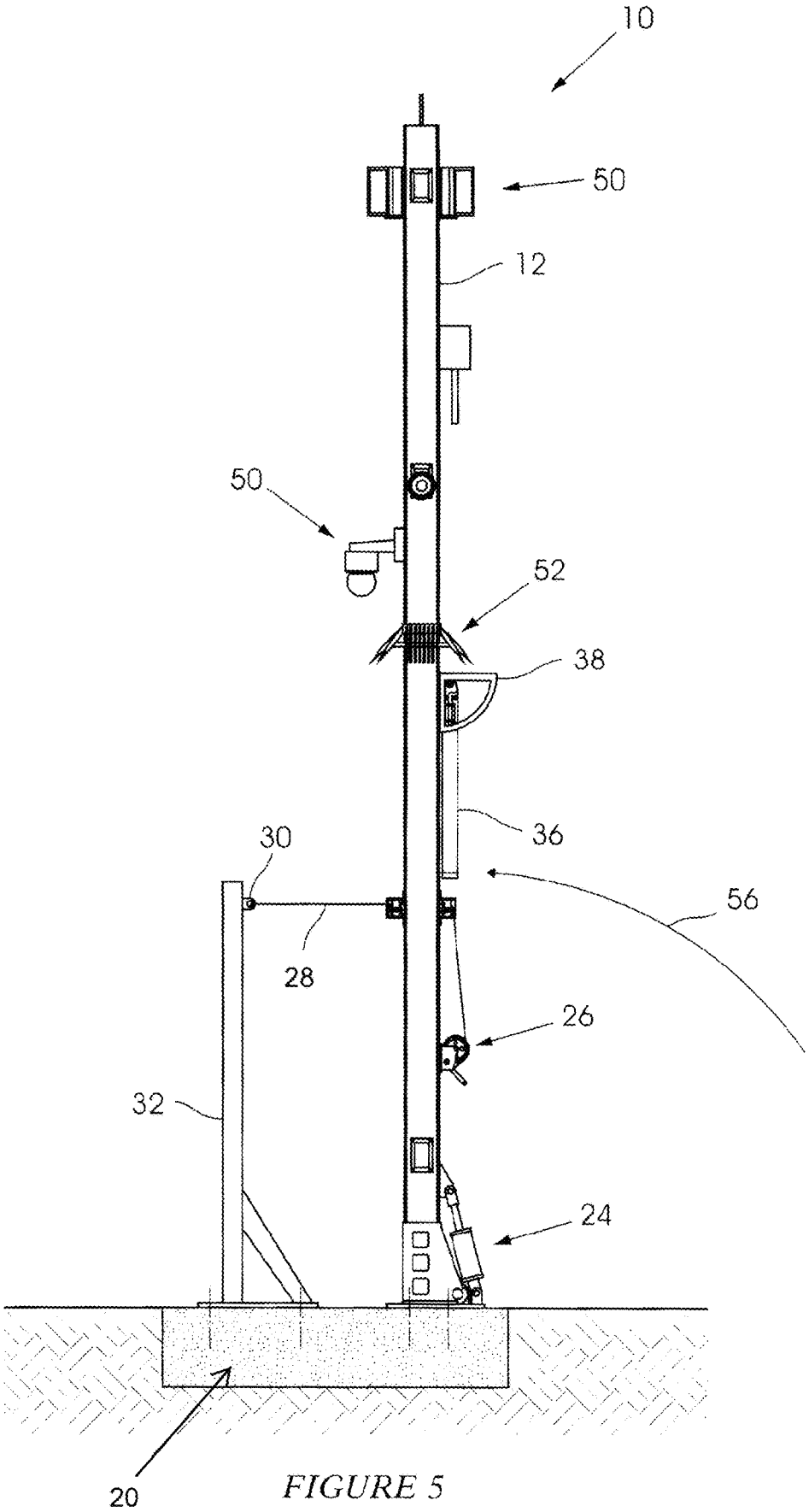
FIG. 5 is a side view of the mast shown in FIG. 1, in use, pivoted to a second position.

In use, the winch 26 is actuable to pay out the cable 28 from the winch 26. This process allows the post 12 to pivot in a first direction 54, under gravity action—shown in FIG. 4. The winch 26 can be actuable in a reverse sense to move the post in a second direction 56, which is opposite to the first direction 54—shown in FIG. 5. The post 12 is thereby elevated and is returned to a vertical position.

The winch 26 can be actuated manually or electrically. In this example the winch 26 includes a handle 58 for manual actuation to pay out the cable 28. The elevated anchor point 30 allows for the winch action to be effective over the angular range of movement of the post. This would not be the case, if, for example the cable were to be anchored directly to the support base 20 i.e. if the support member 32 were not employed.

The cable 28 supports the post 12 and prevents it from falling to the ground. The first mechanism 22 and the second mechanism 34 provide safety and security by preventing the post 12 from falling to the ground if the cable 28 were to break. The mechanism 22 in effect acts a shock-absorber and allows the post to move downwardly in a controlled and safe way. Thus, in use, the first mechanism 22 restricts pivotal movement of the post 12 relative to the support base 20 to dampen such pivotal movement and thereby to prevent abrupt movement of the post. The second mechanism 34 restricts, in this case stops, pivotal movement of the post 12 when the post 12 is at a predetermined orientation relative the vertical. The free-hanging elongate body 36 pivots relative to the post 12, i.e. moves/swings under gravity action, away from the lowering post 12, and remains vertically orientated so that if the cable 28 were to break and if the mechanism 22 failed, the post 12 would not fall to the ground but would be restricted by and fall onto the free-hanging elongate body 36 which would become ground-engaging and support the post 12.

When the post is elevated the mechanism 22 also allows for controlled movement, so that abrupt movements are eliminated.

The advantages of the pivoting mast 10 are that it allows the second end 16 and the components 50 to be lowered in a controlled way to a position at which the components are readily accessible. This is ultimately safer and less likely to give rise to injuries, death, or damage to the components 50. No machinery and equipment, such as ladders and hoists, are required to elevate individuals to access the components 50.

The pivotal mounting of the post to the ground-engaging support base enables the mechanism 22 to be effectively used and for pivotal movement to be controlled by means of the winch, compared for example to a construction in which a half section of the post would be pivotal about a centre point of the post.

The invention claimed is:

1. A mast (10) which includes an elongate post (12) with a first end (14) and a second end (16), the first end (14) being pivotally secured to a ground-engaging support base (20), a first mechanism (22) attached to and between the post (12) and the base (20), a winch (26) which is attached to and which is movable with the post (12), a member (32) which is fixed to the support base (20) and which includes an anchor point (30) at an elevated position relative to the base (20), a cable (28) which is engaged with the winch (26) and which is secured at one end to the anchor point (30), and wherein the winch (26) is actuable to allow the post (12) to pivot about the first end (14), from an elevated position, in a first direction (54) against the action of the first mechanism (22) which acts between the post (12) and the support base (20) to allow controlled gradual pivotal movement of the post (12) as the post (12) is lowered in the first direction (54) to a predetermined angular extent relative to the vertical, and which is actuable to pivot the post (12) in a second direction (56) which opposes the first direction (54) to elevate the post (12).

2. A mast (10) according to claim 1 wherein the first mechanism (22) includes a piston and cylinder arrangement (24).

3. A mast (10) according to claim 2 which includes a second mechanism (34) which comprises a free-hanging elongate body (36) which is pivotally attached to the post (12) and which is movable under gravity action automatically to take up an orientation which allows the body (36) to be ground-engaging to support the post (12) and to prevent further pivotal movement of the post when the post (12) is lowered to a predetermined orientation relative to the vertical.

4. A mast (10) according to claim 1 which includes a second mechanism (34) which comprises a free-hanging elongate body (36) which is pivotally attached to the post (12) and which is movable under gravity action automatically to take up an orientation which allows the body (36) to be ground-engaging to support the post (12) and to prevent further pivotal movement of the post when the post (12) is lowered to a predetermined orientation relative to the vertical.

5. A mast (10) according to claim 1 wherein the post (12) includes a flange (40) at the first end (14) which is pivotally secured to the support base (20).

6. A mast (10) according to claim 1 which includes components (50) mounted at the second end (16) of the post (12) and wherein the components (50) include sensing, monitoring, surveillance, communication and security components.

7. A mast (10) according to claim 6 which includes deterrent elements (52) that are secured at an elevated position to the post to protect the components (50) and wherein the deterrent elements (52) include razor wire, barb wire, barb tape, or spikes.

* * * * *